US009293830B2

(12) United States Patent
Schmidt et al.

(10) Patent No.: US 9,293,830 B2
(45) Date of Patent: Mar. 22, 2016

(54) ANTENNA ELEMENT WITH HIGH GAIN TOWARD THE HORIZON

(71) Applicant: Smartsky Networks LLC, Charlotte, NC (US)

(72) Inventors: Stefan Schmidt, Cary, NC (US); Gerard James Hayes, Wake Forest, NC (US)

(73) Assignee: SMARTSKY NETWORKS LLC, Charlotte, NC (US)

( * ) Notice: Subject to any disclaimer, the term of this patent is extended or adjusted under 35 U.S.C. 154(b) by 113 days.

(21) Appl. No.: 14/208,656

(22) Filed: Mar. 13, 2014

(65) Prior Publication Data

US 2014/0266932 A1 Sep. 18, 2014

Related U.S. Application Data

(60) Provisional application No. 61/779,100, filed on Mar. 13, 2013.

(51) Int. Cl.

| | |
|---|---|
| ***H01Q 1/00*** | (2006.01) |
| ***H01Q 9/16*** | (2006.01) |
| ***H01Q 1/28*** | (2006.01) |
| ***H01Q 9/18*** | (2006.01) |
| ***H01Q 9/32*** | (2006.01) |
| ***H01Q 13/08*** | (2006.01) |

(52) U.S. Cl.

CPC ..... *H01Q 9/16* (2013.01); *H01Q 1/286* (2013.01); *H01Q 9/18* (2013.01); *H01Q 9/32* (2013.01); *H01Q 13/085* (2013.01)

(58) Field of Classification Search

CPC ..... H01Q 1/286; H01Q 9/32; H01Q 9/18; H01Q 13/085; H01Q 9/16

USPC ..... 343/712, 843, 793, 767

See application file for complete search history.

(56) References Cited

U.S. PATENT DOCUMENTS

| | | | | |
|---|---|---|---|---|
| 5,067,172 | A * | 11/1991 | Schloemer | H04B 7/26 455/431 |
| 7,113,780 | B2 * | 9/2006 | McKenna | H01Q 1/007 398/115 |
| 7,920,860 | B2 * | 4/2011 | Chari et al. | H01Q 1/283 455/422.1 |
| 8,676,192 | B2 * | 3/2014 | Jalali | H01Q 1/2291 455/432.1 |
| 2014/0327577 | A1 * | 11/2014 | Ozaki | H01Q 3/26 342/367 |

* cited by examiner

*Primary Examiner* — Brian Young

(74) *Attorney, Agent, or Firm* — Nelson Mullins Riley & Scarborough LLP

(57) ABSTRACT

An air-to-ground network communication device may include a conductive groundplane and an antenna element. The conductive groundplane may be disposed to be substantially parallel to a surface of the earth. The antenna element may extend substantially perpendicularly away from the groundplane and may have an effective length between about 1λ to about 1.5λ. The antenna element may be disposed at a distance of about 0.5λ to about 1λ from the groundplane.

18 Claims, 8 Drawing Sheets

ANTENNA ELEMENT WITH HIGH GAIN TOWARD THE HORIZON

TECHNICAL FIELD

Example embodiments generally relate to wireless communications and, more particularly, relate to an antenna element that provides increased gain toward the horizon.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

However, in spite of the familiarity that people have with remaining continuously connected to networks while on the ground, people generally understand that easy and/or cheap connectivity will tend to stop once an aircraft is boarded. Aviation platforms have still not become easily and cheaply connected to communication networks, at least for the passengers onboard. Attempts to stay connected in the air are typically costly and have bandwidth limitations or high latency problems. Moreover, passengers willing to deal with the expense and issues presented by aircraft communication capabilities are often limited to very specific communication modes that are supported by the rigid communication architecture provided on the aircraft.

Conventional ground based communication systems have been developed and matured over the past couple of decades. While advances continue to be made in relation to ground based communication, and one might expect that some of those advances may also be applicable to communication with aviation platforms, the fact that conventional ground based communication involves a two dimensional coverage paradigm and that air-to-ground (ATG) communication is a three dimensional problem means that there is not a direct correlation between the two environments. Instead, many additional factors must be considered in the context of ATG relative to those considered in relation to ground based communication.

One such area in which further consideration may be required relates to the antennas employed for ATG network communications. A typical aerial antenna includes a flush-mounted (e.g. cavity, patch, and slot) element or an above-surface (e.g. monopole and dipole) configuration. In order to reduce or minimize aerial resistance (drag), a low mechanical form factor is also generally desirable. Accordingly, above-surface antennas are typically designed to provide a relatively broad area of coverage with a relatively low-gain. Thus, above-surface antennas are frequently constructed using ¼-wave, vertically-polarized monopole antennas or elevated horizontally-polarized dipoles. However, as wireless communications become a commercial necessity that demands that better and more cost effective service be provided to airborne passengers, the costs and performance capabilities of networks supported by such antennas may render such networks incapable of meeting consumer demands.

BRIEF SUMMARY OF SOME EXAMPLES

Some example embodiments may therefore be provided to provide antenna configurations that provide improved characteristics which, when translated into network usage, may improve network performance so that ATG networks can perform at expected levels within reasonable cost structures. In some embodiments, an omni-directional antenna configuration may be provided that can increase gain toward the horizon. Some embodiments may also improve bandwidth via modification of antenna elements. Accordingly, for example, signal coverage may be improved with relatively low cost equipment since fewer base stations may be needed to accommodate antennas that have omni-directional performance with a relatively high gain.

In one example embodiment, an air-to-ground network communication device is provided. The device may include a conductive groundplane and an antenna element. The conductive groundplane may be disposed to be substantially parallel to a surface of the earth. The antenna element may extend substantially perpendicularly away from the groundplane and may have an effective length between about 1λ to about 1.5λ. The antenna element may be disposed at a distance of about 0.5λ to about 1λ from the groundplane.

In another example embodiment, a mobile platform is provided. The mobile platform includes a conductive groundplane and an antenna element. The conductive groundplane may be disposed to be substantially parallel to a surface of the earth while the mobile platform is in motion. The antenna element may extend substantially perpendicularly away from the groundplane and may have an effective length between about 1λ to about 1.5λ. The antenna element may be disposed at a distance of about 0.5λ to about 1λ from the groundplane.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 illustrates the directivity pattern of a ½ wavelength (½λ) dipole antenna element;

FIG. 2, which includes FIGS. 2A, 2B, 2C, 2D, 2E and 2F, illustrates several examples of antenna elements positioned proximate to a groundplane and their corresponding equivalent image elements due to the placement of such elements proximate to a groundplane that is approximately infinite relative to the lengths of the antenna elements in accordance with an example embodiment;

DETAILED DESCRIPTION

Figure 1:
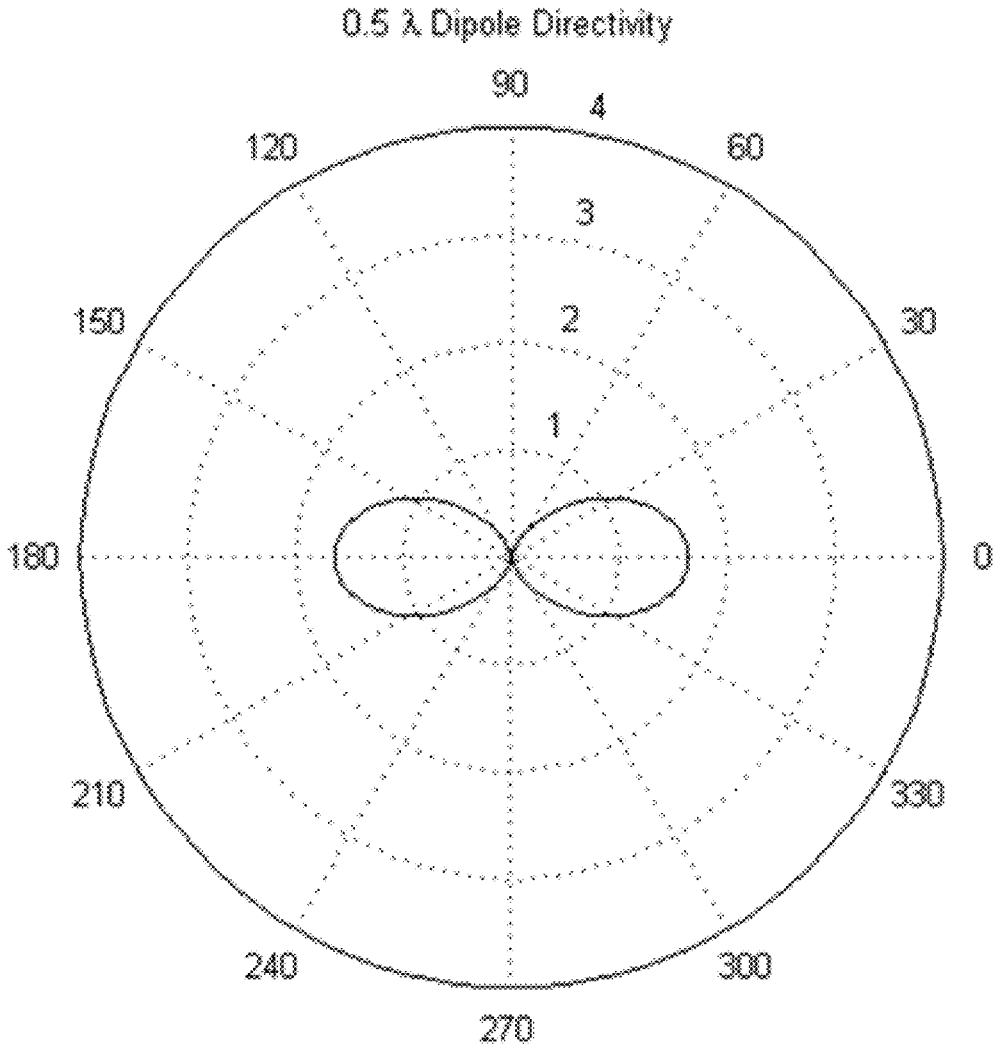

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true.

Some example embodiments described herein provide architectures for improved antenna design. In this regard, some example embodiments may provide for an antenna design that may provide improved gain toward the horizon in an omni-directional structure. The improved gain toward the horizon may enable aircraft to engage in communications with potentially distant base stations on the ground. Accordingly, an ATG network may potentially be built with base stations that are much farther apart than the typical distance between base stations in a terrestrial network.

Conventional antennas are formed by embedding conductors of structured shapes within a surrounding medium. The surrounding medium can be air or other non-conducting (insulating) media. The resulting local fields and currents in response to the differently shaped material properties and alternating currents applied to the antenna input ports determine the direction and polarization of radiated fields as well as the observed frequency dependent impedance at the antenna port. A class of antennas that is used often is that of linear antennas such as straight monopole or dipole elements. These elements are often sized such that their length is approximately ½ of the wavelength (½λ) of the resonant frequency of the antenna, and as such they become resonant. At this resonance the input impedance is purely real and the reactive component vanishes. This is convenient as the antenna can be directly connected to a transmission line and the transmission line would not carry losses due to additional reactive fields or currents.

The geometry of vertically oriented linear antenna elements, and as such their radiating currents and fields, are generally independent of the azimuth angle of observation. Furthermore, the radiated or received field intensity (or directivity) of such elements is also independent of the azimuth angle. In other words, the radiation pattern is omni-directional (in azimuth) and has a characteristic radiation pattern in the elevation angle. FIG. 1 illustrates the directivity pattern of a typical ½ wavelength (½ λ) dipole antenna element. The maximum directivity of a ½ wavelength dipole is ~1.7 in the broadside direction.

It should be understood that the directivity pattern shown in FIG. 1 is swept over 360 degrees around the antenna element to form a donut shape around the antenna element. Accordingly, in applications where such an antenna is mounted to an aerial vehicle, such a vertically placed linear antenna may be particularly useful in the sense that the antenna may exhibit antenna gain and selectivity towards and in all directions of the horizon. Given the elevation of the aerial vehicle, relatively distant base stations may be within the line-of-sight and reachable if antenna gain is sufficient. Thus, by using an antenna with a high antenna gain directed toward the horizon, the capabilities and advantages offered by virtue of the elevation of the aerial vehicle may be more fully leveraged.

The fuselage or wings of an aerial vehicle may be made of a conductive material (e.g., aluminum, conductive composite materials, etc.). Alternatively, for composite materials that are not conductive, a mesh or substrate of conductive material may be provided over or within the composite material forming the skin of the aerial vehicle. The conductive material may form a relatively large (e.g., approximately infinite) conductive groundplane. In cases in which the groundplane is very large compared to the wavelength of operation, a single monopole element may be considered to be equivalent to a single dipole element. FIG. 2, which includes FIGS. 2A, 2B, 2C, 2D, 2E and 2F, illustrates several examples of antenna elements positioned proximate to a groundplane (see FIGS. 2A, 2C and 2E) and their corresponding equivalent image elements (see FIGS. 2B, 2D and 2F) due to the placement of such elements proximate to a groundplane that is approximately infinite relative to the lengths of the antenna elements.

Figure 2A:
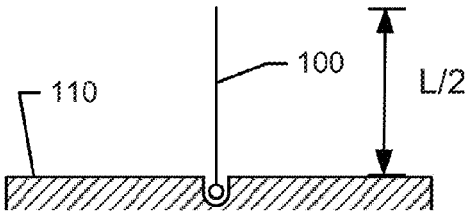
Figure 2B:
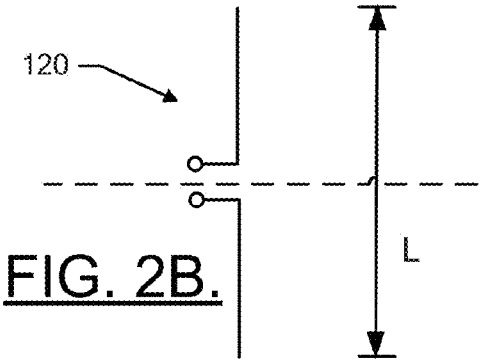

FIG. 2A illustrates an example of a single monopole element 100 that is disposed as a radiating element having a length of L/2 proximate to a groundplane 110 in the form of aircraft skin. The groundplane 110 may reflect an image of the monopole element 100 such that the equivalent image of the monopole element as seen by a distant object may be the equivalent array 120 shown in FIG. 2B. In this regard, FIG. 2B illustrates the equivalent array 120 as a dipole element having double the length of the monopole element 100 (i.e., 2 times L/2, or L).

Figure 2C:
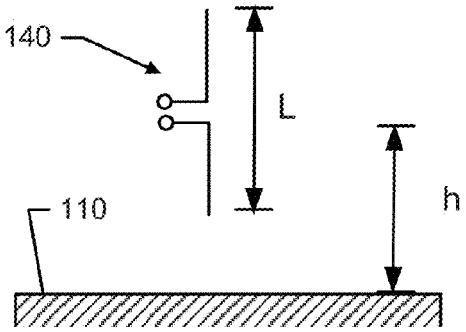
Figure 2D:
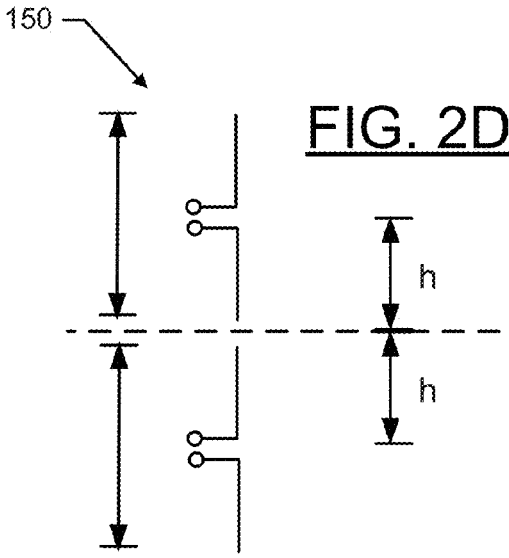
Figure 2E:
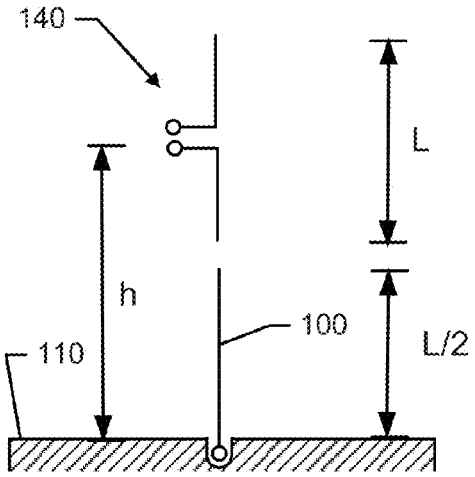
Figure 2F:
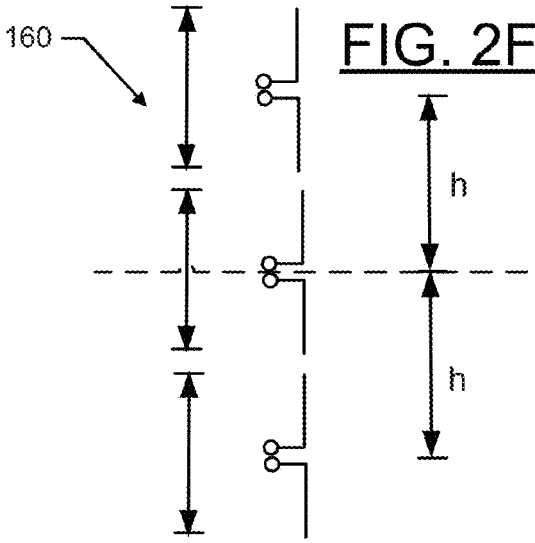

Further focusing of transmitted power or received sensitivity towards the horizon (antenna gain) can be achieved by stacking multiple elements in a broadside radiating antenna array. In the case of a dipole element 140 mounted at a distance h above (or below) the groundplane 110 as shown in FIG. 2C, the equivalent array 150 may appear as an array of two identical antenna elements as shown in FIG. 2D, with increased antenna directivity. Furthermore, if the monopole element 100 is employed together with the dipole element 140 above the ground plane 110 as shown in FIG. 2E, the equivalent array 160 may appear as an array of three antenna elements further increasing directivity as shown in FIG. 2F. This concept can be extended by further increasing the number of array elements. In theory, there is no limit to the number of elements that can be stacked. However, for practical purposes, the complexity of providing connections and phasing to the increased number of elements also increases so that the usefulness of the concept is at least in part limited by cost and complexity concerns. Moreover, the length of the elements may increase the profile and drag associated with the antenna, so that aerial vehicle implementation becomes less practical.

Figure 3:
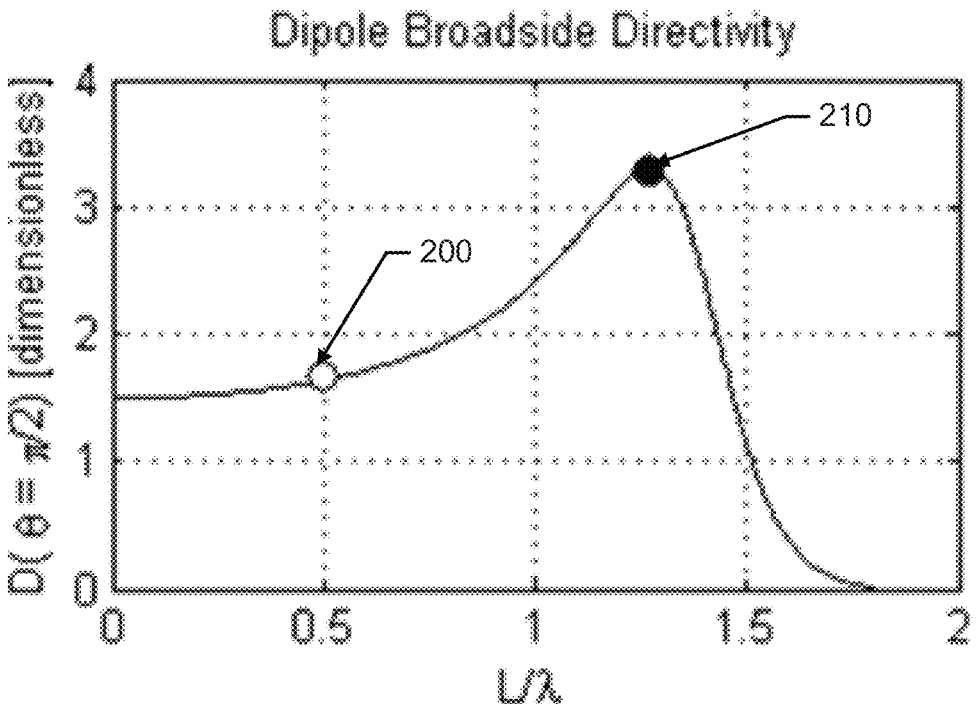
FIG. 3 shows the broadside directivity as a function of element length according to an example embodiment.

In the context of an ATG network, the directivity of a single element of ½-wavelength that is typically used may not be optimal. Instead, further broadside directivity and focusing towards the horizon may vastly improve the antenna performance so that favorable network characteristics can be achieved in terms of cost and bandwidth. Accordingly, some example embodiments may employ the use of longer antenna elements. FIG. 3 shows the broadside directivity as a function of element length. As can be appreciated from FIG. 3, the typical broadside directivity of 1.7 that is achievable using a ½-wavelength antenna design (shown at point 200) can be improved, and in fact optimized, by increasing element length until broadside gain reaches its first maximum at a length of about 1.25 lambda (1.25×) as shown at point 210. The directivity at point 210 is about 3.3.

Figure 4:
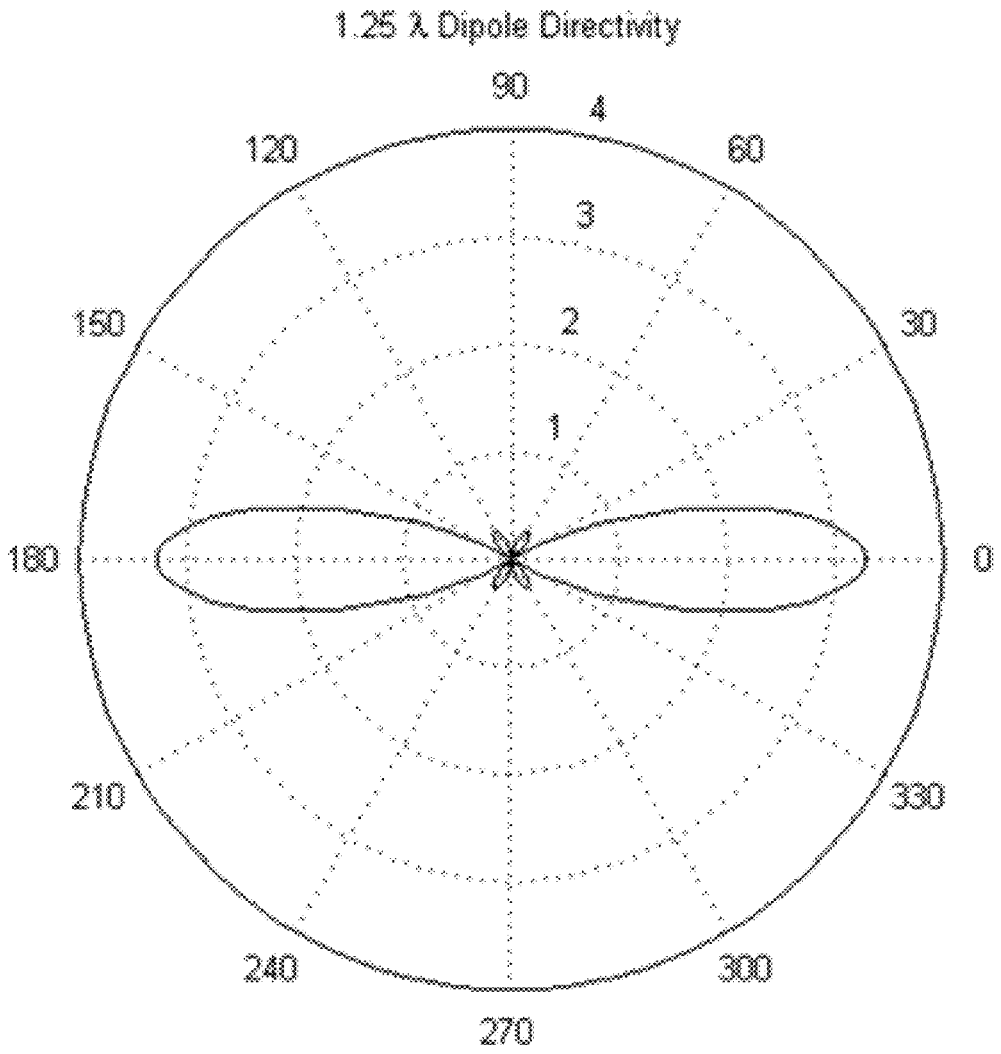
FIG. 4 illustrates the directivity pattern of a 1.25 wavelength dipole according to an example embodiment.

Accordingly, as can be appreciated from the combination of the content of FIGS. 2 and 3, any one of the radiating element structures of FIGS. 2A, 2C and 2E could be employed using a length of about 1.25 lambda (1.25λ) to achieve improved directivity toward the horizon. FIG. 4 illustrates the directivity pattern of a 1.25 wavelength dipole. The maximum directivity of a 1.25 wavelength dipole is ~3.3 in the broadside direction, providing approximately 3 dB more gain than the typical ½ wavelength dipole antenna. Again, it should be understood that the directivity pattern as a function of elevation, which is shown in FIG. 4 is applicable 360 degrees around the antenna element to form a donut shape with the antenna element at the center of the donut shape. As can further be appreciated from FIG. 4, sidelobes begin to be created (e.g., at elevations of 60, 120, 240 and 300 degrees). These sidelobes may be undesirable, which may help to explain at least in part why antennas of this length are not typically employed. However, the sidelobes could be tolerated or minimized through other design features that may be added to some embodiments.

Longer element lengths, as provided in example embodiments, may be applied to any of the stacked element array schemes as illustrated in FIG. 2. As such, a design may be formulated to provide desirable gain characteristics using a corresponding desired number of elements to achieve a certain directivity goal. However, it should be appreciated that by using longer element lengths than the typical ½-wavelength antenna design, antenna import impedances will no longer be purely real, but will instead further include reactive components. However, this reactance can be cancelled out (matched) with conjugate reactive elements.

Figure 5:
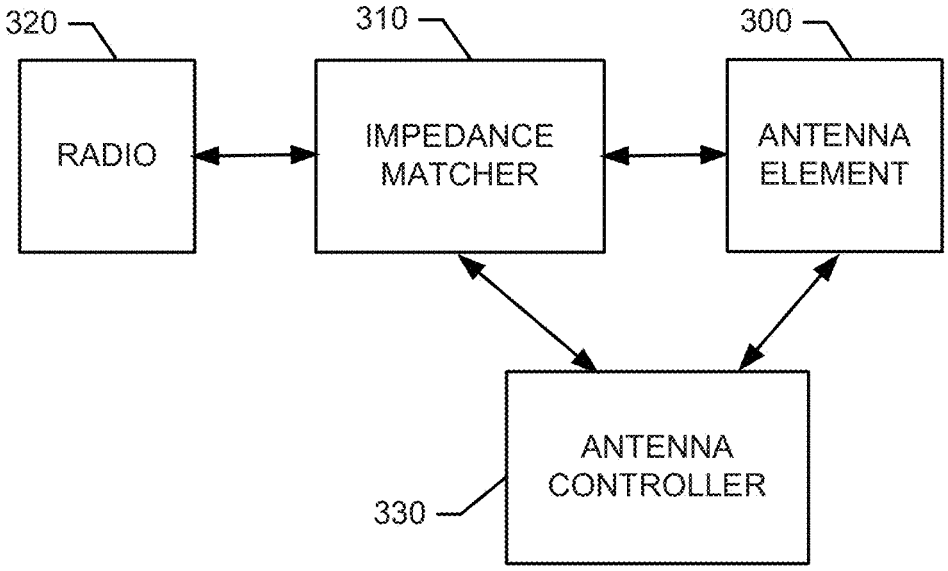
FIG. 5 illustrates a block diagram of a system employing a longer antenna element according to an example embodiment.

FIG. 5 illustrates a block diagram of a system employing a longer antenna element according to an example embodiment. As shown in FIG. 5, an antenna 300 may be employed in which it is assumed that at least one antenna element having a longer wavelength (e.g., 1.25 wavelength dipole) than a typical ½ lambda antenna element is employed. The antenna 300 may be operably coupled to an impedance matcher 310 that may include reactive elements configured to cancel out or match the reactive components of the antenna 300. The impedance matcher 310 may then be operably coupled to a radio 320 that may be configured to provide electronics for driving the antenna 300 during transmission and for processing received signals when the antenna 300 is receiving transmissions. The combined antenna-reactance-network formed by the antenna 300 and the impedance matcher 310 may form a resonant circuit that can be connected to a transmission line operably coupled to the radio 320 with minimal loss. One advantage of this approach is that higher directivity can be achieved with relatively fewer antenna (array) elements than that which is found conventionally.

It should also be appreciated that some alternative embodiments may employ other than end or center feed options relative to feeding the antenna 300 in order to minimize reactive components without the use of an impedance matcher 310. Moreover, some embodiments may employ a number of antenna elements that may be electrically connected or disconnected based on operator control or based on control decisions made by an antenna controller 330. The antenna controller 330 may include at least a processor and memory storing instructions for execution by the processor. The antenna controller 330 may be configured (e.g., via the instructions) to electrically connect or disconnect antenna elements in a desired arrangement within the antenna 300 based on operator control, current conditions or other predetermined criteria. The antenna controller 330 may also employ any needed internal portions or components of the impedance matcher 310 in order to provide cancellation of the reactive components associated with any particular selected antenna element configuration that is to be employed in the antenna 300.

Although any of the antenna element designs of FIG. 2 may be employed in accordance with example embodiments, it should be appreciated that there are different gains associated with each respective design, and corresponding different antenna heights that would result from selection of each design. Table 1 below illustrates a series of different antenna designs and the corresponding total height and horizon gain associated with each different design. As shown in FIG. 2, the placement of a higher gain element above a groundplane (e.g. the surface or skin of an aircraft) results in an array effect created by the element and its electromagnetic image in the groundplane. By varying the height, h, above the surface, higher gains near the horizon can be achieved. A summary of various possibilities are tabulated in Table 1 below:

TABLE 1

| | Total Height | Horizon Gain |
|---|---|---|
| 1.2 lambda monopole | 72 mm | 7.9 dBi |
| 0.5 lambda dipole, 0.45 lambda above GP | 91 mm | 8.6 dBi |
| 1.05 lambda dipole, 0.5 lambda above GP | 156 mm | 10.4 dBi |
| 1.2 lambda dipole, 0.68 lambda above GP | 189 mm | 11.1 dBi |

Figure 6:
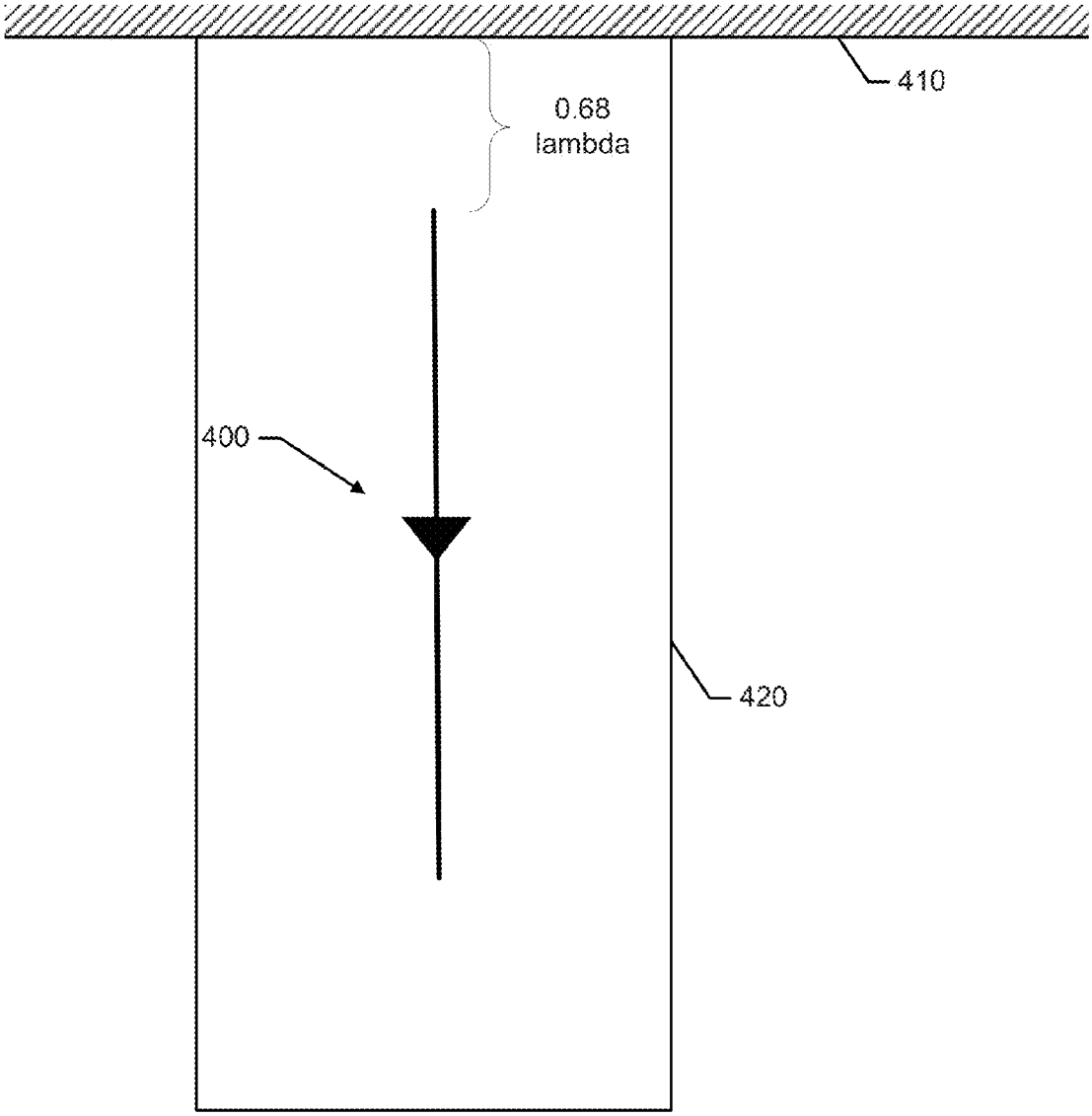
FIG. 6 illustrates an example embodiment of a 1.2 lambda dipole antenna element 400 with 0.68 lambda separation from a groundplane according to an example embodiment.

As shown in Table 1, the highest horizon gain (e.g., 11.1 dBi) is achieved by placing a dipole antenna having about a 1.2 lambda length above the groundplane by about 0.68 lambda. This corresponds to the example of FIGS. 2C and 2D. FIG. 6 illustrates an example embodiment of a 1.2 lambda dipole antenna element 400 with 0.68 lambda separation from a groundplane 410, which in this example represents the skin of an aircraft. The antenna element 400 is disposed within a housing 420 and is therefore deployable on the aircraft. However, it should also be appreciated that some embodiments may also be practiced in the context of a terrestrial base station. In such an example, the groundplane 410 may be provided by a metallic (or other conductive material) disposed in a platform upon which the antenna element 400 may be supported. Thus, the structure may be similar to that which is shown in FIG. 6, except that the orientation would be inverted such that the groundplane 410 is on the bottom and the antenna element 400 and housing 420 extend upward from the platform that forms the groundplane 410 instead of downward (i.e., as from a wing or body portion of an aircraft) as shown in FIG. 6.

Figure 7:
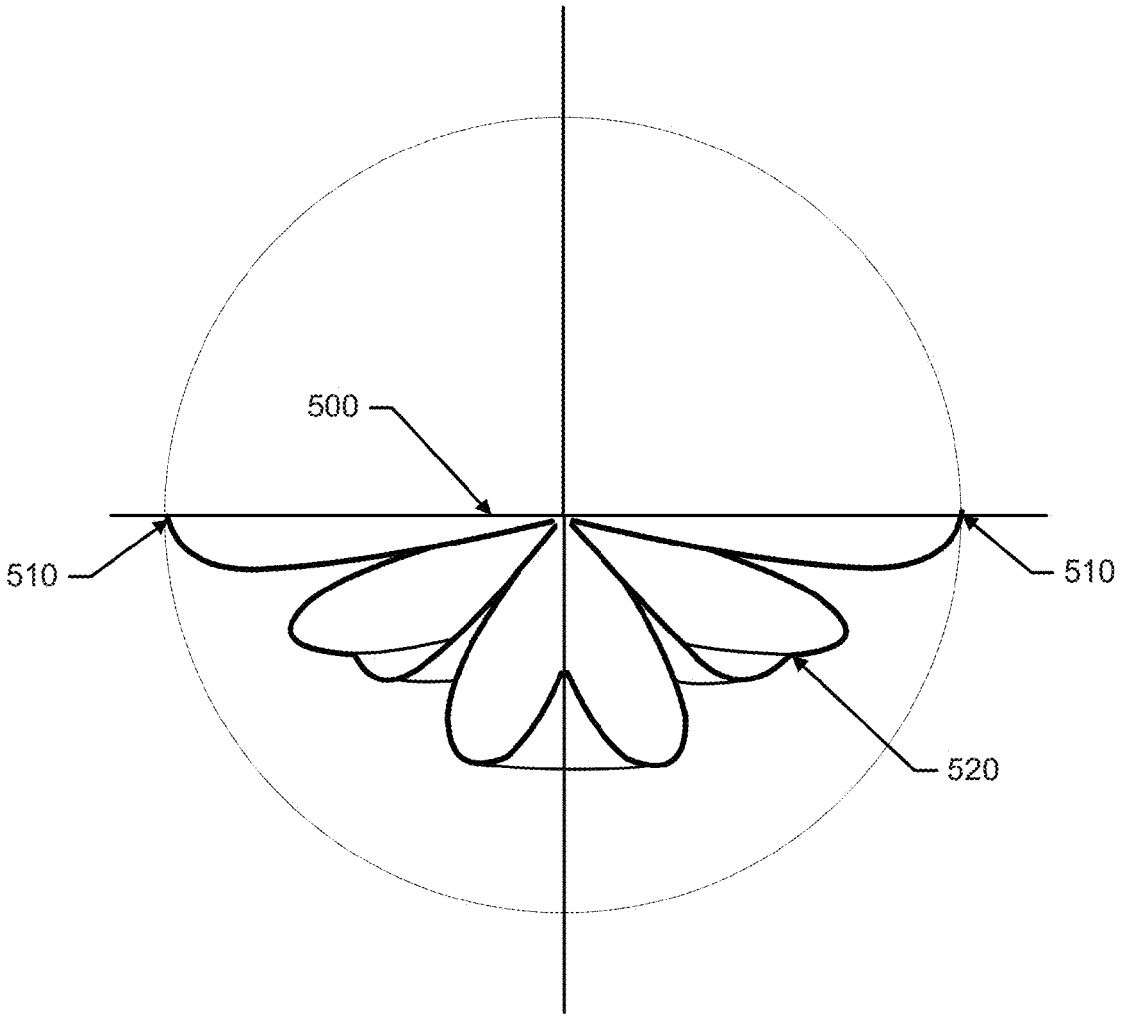
FIG. 7 illustrates a radiation pattern associated with the example antenna element of FIG. 6 according to an example embodiment.

A radiation pattern 500 associated with the example antenna element 400 of FIG. 6 is shown in FIG. 7. As shown in FIG. 7, there is an 11.1 dBi gain directed toward the horizon at points 510. As mentioned above, the sidelobes 520 may be removed or clipped, if desired. In some embodiments, a patch antenna could be provided in combination with the antenna element 400 in order to provide higher gain and coverage for areas directly below the aircraft (or above the base station in the case of a terrestrial communication station implementation).

Figure 8:
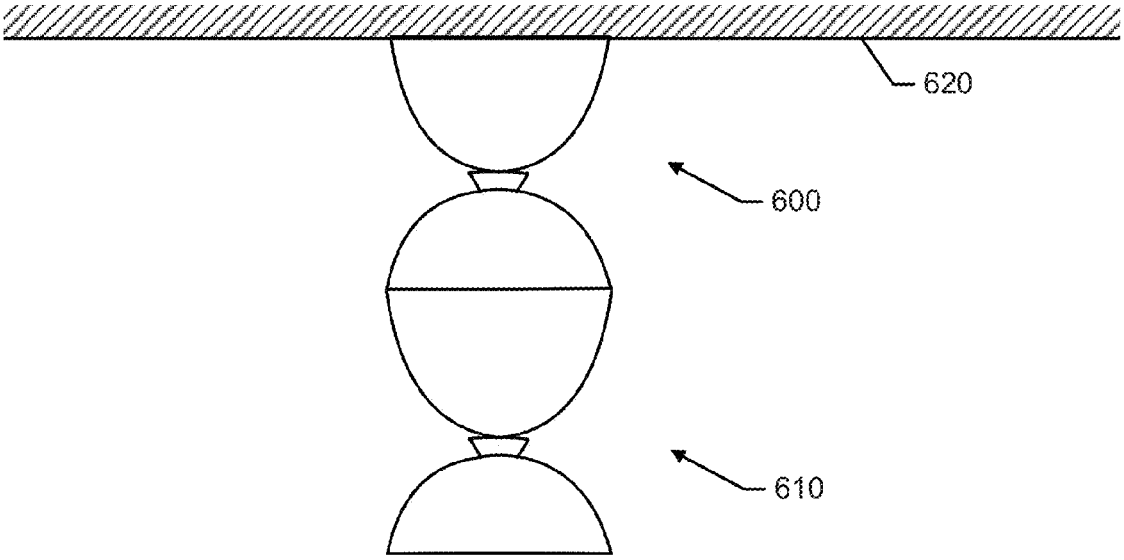
FIG. 8 illustrates an antenna element formed from non-linear shaped components in accordance with an example embodiment.

In describing example embodiments, relatively linear antenna elements (e.g., monopoles and dipoles) have been employed for illustrative purposes thus far. However, it should be appreciated that alternative embodiments may also employ other antenna element shapes and configurations. For example, conical, spherical and/or elliptical shaped curved surfaces may also be employed as antenna elements in some embodiments. FIG. 8 illustrates an example embodiment in which two antenna element 600 and 610 are provided proximate to a groundplane 620 (i.e., conductive skin of an aircraft or a conductive platform having at least a 3 ft diameter). Each of the antenna elements 600 and 510 includes spherical and elliptical components provided in combination. However, other shapes could alternatively be employed.

Embodiments that employ Vivaldi-antenna elements and/or the shapes described above may have improved impedance matching characteristics and broader operational bandwidth characteristics as compared to the monopole and dipole configurations. However, the element length parameters discussed above may still be effectively employed in order to improve directivity toward the horizon.

Accordingly, an example embodiment may provide an aircraft employing an antenna element with an effective length between about 1 to 1.5λ, at a distance of about 0.5 to about 1λ from a groundplane formed at or by the skin of the aircraft. In an example embodiment, the effective length may be about 1.2λ and the distance from the groundplane formed at or by the skin of the aircraft may be about 0.68%. As an example, for a 1 GHz signal, λ may be about 30 cm. The antenna element may be selected to have a length of L=36 cm (1.2λ). However, example embodiments may be practiced in connection with any number of different frequencies as well, and the lengths of antenna elements would be adjusted accordingly. For example, some embodiments may be practiced in connection with unlicensed communication bands (e.g., 2.4 GHz and 5.8 GHz), but any suitable frequencies may be employed. Antenna elements of example embodiments may enable superior directivity to be provided toward the horizon, and may also be duplicated at a ground transmission station either alone or in combination with other antenna elements that may provide coverage for vertical orientations.

In an example embodiment, an air-to-ground network communication device is provided. The device may include a conductive groundplane and an antenna element. The conductive groundplane may be disposed to be substantially parallel to a surface of the earth. The antenna element may extend substantially perpendicularly away from the groundplane and may have an effective length between about 1λ to about 1.5λ. The antenna element may be disposed at a distance of about 0.5λ to about 1λ from the groundplane.

In an example embodiment, the device may include additional, optional features, and/or the features described above may be modified or augmented. Each of the numbered modifications or augmentations below may be implemented independently or in combination with each other respective one of such modifications or augmentations, except where such combinations are mutually exclusive. Some examples of modifications, optional features and augmentations are described below. In this regard, for example, in some cases, (1) the effective length of the antenna element may be about 1.2λ and the distance from the groundplane is about 0.68λ. In some embodiments, (2) the groundplane may be formed at a skin of an aircraft. Alternatively, (3) the groundplane may be formed at a platform of a ground transmission station. In an example embodiment, (4) the antenna element may be a dipole element. The groundplane of some embodiments may extend at least 3 feet in every direction away from the antenna element. In some embodiments, (5) the antenna element comprises a Vivaldi-antenna. In an example embodiment, (6) the antenna element may include non-linear shaped elements such as conical, spherical or elliptical shaped elements. In some cases, (7) the device may further include an impedance matcher operably coupled to the antenna element to cancel reactive components of impedance of the antenna element. The impedance matcher may be operably coupled to an antenna controller that may be configured to enable modification of the impedance matcher to cancel different reactive component values associated with different switchable antenna element configurations of the antenna element. In an example embodiment, (8) the antenna element may include switchable components that are configured to be arranged in at least two different configurations that each have the effective length between about 1λ to about 1.5λ.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An air-to-ground network communication device, the device comprising:

a conductive groundplane disposed to be substantially parallel to a surface of the earth; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element comprises a dipole element.

2. The device of claim 1, wherein the effective length of the antenna element is about 1.2λ and the distance from the groundplane is about 0.68λ.

3. The device of claim 1, wherein the groundplane is formed at a skin of an aircraft.

4. The device of claim 1, wherein the groundplane is formed at a platform of a ground transmission station.

5. An air-to-ground network communication device, the device comprising:

a conductive groundplane disposed to be substantially parallel to a surface of the earth; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the goundplane, wherein the antenna element comprises a Vivaldi-antenna.

6. An air-to-ground network communication device, the device comprising:

a conduction groundplane disposed to be substantially parallel to a surface of the earth; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element comprises non-linear shaped elements.

7. An air-to-ground network communication device, the device comprising:

a conductive groundplane disposed to be substantially parallel to a surface of the earth;

an antenna element having an omni-directional radiation pattern, the antenna element extending substantially perpendicularly away from the groundplane and having an effective length between about 1λ to about 1.5λ, wherein the antenna element is disposed at a distance of about 0.5λ about 1 λ from the groundplane; and an impedance matcher operable coupled to the antenna element to cancel reactive components of impedance of the antenna element.

8. The device of claim 7, wherein the impedance matcher is operably coupled to the antenna controller that is configured to enable modification of the impedance matcher to cancel different reactive component values associated with different switchable antenna element configurations of the antenna element.

9. An air-to-ground network communication device, the device comprising:

a conductive groundplane disposed to the substantially parallel to a surface of the earth; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element includes switchable components that are configured to be arranged in at least two different configurations that each have the effective length between about 1λ to about 1.5λ.

10. A mobile platform comprising:

a conductive groundplane disposed to be substantially parallel to a surface of the earth while the mobile platform is in motion; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element comprises a dipole element.

11. A mobile platform of claim 10, wherein the effective length of the antenna element is about 1.2λ and the distance from the groundplane is about 0.68λ.

12. The mobile platform of claim 10, wherein the groundplane is formed at a skin of an aircraft.

13. The mobile platform of claim 10, wherein the groundplane extends for at least three feet in every direction away from the antenna element.

14. The mobile platform comprising:

a conductive groundplane disposed to be substantially parallel to a surface of the earth while the mobile platform is in motion; and an antenna element having an omni-directional radiation pattern, the antenna element extending substantially perpendicularly away from the groundplane and having an effective length between about 1λ to about 1.5λ, wherein the antenna element is disposed at a distance of about 0.5λ from the groundplane, wherein the antenna element comprises a Vivaldi-antenna.

15. The mobile platform comprising:

a conductive groundplane disposed to be substantially parallel to a surface of the earth while the mobile platform is in motion; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element comprises non-linear shaped elements.

16. A mobile platform comprising:

a conductive groundplane disposed to be substantially parallel to a surface of the earth while the mobile platform is in motion;

an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane; and an impedance matcher operable coupled to the antenna element to cancel reactive components of impedance of the antenna element.

17. The mobile platform of claim 16, wherein the impedance matcher is operable coupled to an antenna controller that is configured to enable modification of the impedance matcher to cancel different reactive component values associated with different switchable antenna element configurations of the antenna element.

18. A mobile platform comprising:

a conductive groundplane disposed to be substantially parallel to a surface of the earth while the mobile platform is in motion; and an antenna element having an omni-directional radiation pattern, the antenna element extending substantially perpendicularly away from the groundplane and having an effective length between about 1λ to about 1.5λ, wherein the antenna element is disposed at a distance of about 0.5λ to about 1λ from the groundplane, wherein the antenna element includes switchable components that are configured to be arranged in at least two different configurations that each have the effective length between about 1λ to about 1.5λ.

* * * * *